US009704674B2

(12) United States Patent
Kester et al.

(10) Patent No.: US 9,704,674 B2
(45) Date of Patent: Jul. 11, 2017

(54) FUSE HOLDER

(71) Applicant: Hubbell Incorporated, Shelton, CT (US)

(72) Inventors: Jeffery Joseph Kester, Chippewa Lake, OH (US); Lloyd Ronald Beard, Centralia, MO (US); Sterlin Cochran, McCalla, AL (US); Bryant Haines, Birmingham, AL (US); Charles Worthington, Birmingham, AL (US)

(73) Assignee: Hubbell Incorporated, Shelton, CT (US)

( * ) Notice: Subject to any disclaimer, the term of this patent is extended or adjusted under 35 U.S.C. 154(b) by 140 days.

(21) Appl. No.: 14/330,531

(22) Filed: Jul. 14, 2014

(65) Prior Publication Data

US 2016/0013002 A1 Jan. 14, 2016

(51) Int. Cl.

| | |
|---|---|
| ***H01H 85/20*** | (2006.01) |
| ***H01H 85/38*** | (2006.01) |
| ***H01H 31/12*** | (2006.01) |

(52) U.S. Cl.

CPC ..... *H01H 31/127* (2013.01); *H01H 85/20* (2013.01); *H01H 85/38* (2013.01); *H01H 2085/388* (2013.01)

(58) Field of Classification Search

CPC .. H01H 85/20; H01H 85/38; H01H 2085/388; H01H 31/127

USPC ..... 337/246

See application file for complete search history.

(56) References Cited

U.S. PATENT DOCUMENTS

| | | | | |
|---|---|---|---|---|
| 2,581,954 A * | 1/1952 | Hubbard | H01H 31/127 | 337/167 |
| 2,816,981 A * | 12/1957 | Lindell | H01H 31/006 | 218/12 |
| 3,102,178 A * | 8/1963 | Bronikowski | H01H 31/127 | 337/223 |
| 3,152,236 A * | 10/1964 | Schultz | H01H 85/38 | 337/231 |
| 3,588,607 A * | 6/1971 | Ristuccia | H01F 27/402 | 337/201 |
| 3,827,010 A * | 7/1974 | Cameron | H01H 31/127 | 337/168 |
| 4,011,537 A | 3/1977 | Jackson et al. | | |
| 4,307,369 A | 12/1981 | Jackson | | |

(Continued)

FOREIGN PATENT DOCUMENTS

CN 202473807 U 10/2012

OTHER PUBLICATIONS

PCT/US2015/040278 International Search Report and Written Opinion dated Dec. 8, 2015.

*Primary Examiner* — Anatoly Vortman
(74) *Attorney, Agent, or Firm* — Michael Best & Friedrich, LLP

(57) ABSTRACT

A fuse holder for a fuse cutout includes a molded member including a short fuse tube section and a downwardly extending fin member adapted for securing to a trunnion assembly. An arc quenching liner is disposed in the interior of the tube section and a top casting is connected to the top of the fuse holder and adapted to receive and hold an arc flange of an arc sleeve on a top edge, thereby keeping the arc flange above the top casting. A conductive screw cap seals the assembly. The shorter tube and the provision of the arc flange above the top casting provides superior arc quenching properties.

20 Claims, 8 Drawing Sheets

(56) References Cited

U.S. PATENT DOCUMENTS

| | | | | |
|---|---|---|---|---|
| 4,961,063 | A * | 10/1990 | Lockaby | H01H 85/303 116/202 |
| 5,502,427 | A * | 3/1996 | Scherer | H01H 31/127 337/159 |
| 6,462,639 | B1 | 10/2002 | Farag et al. | |
| 6,820,505 | B2 | 11/2004 | Veverica et al. | |
| 6,952,154 | B2 * | 10/2005 | Almgren | H01H 31/127 337/171 |
| 7,898,380 | B2 * | 3/2011 | Van Heerden | H01H 85/28 337/170 |
| 2004/0081782 | A1 | 4/2004 | Stavnes et al. | |
| 2010/0044345 | A1 * | 2/2010 | Oberg | H01H 1/021 218/146 |

* cited by examiner

FUSE HOLDER

FIELD OF THE INVENTION

The present invention relates to fuse holders for power distribution systems. More particularly, the present invention relates to an improved fuse holder for a fuse cutout.

BACKGROUND OF THE INVENTION

Fuse holders for fuse cutouts and the like are known in the art. For example, in electrical distribution systems, a fuse cutout is a combination of a fuse deployed in a fuse holder and a switch found primarily in overhead feeder lines to protect distribution systems and transformers from current surges and overloads. If equipped with appropriate mechanisms, cutouts can act as sectionalizers, used on each distribution line downstream from autoreclosing circuit breakers. Autoreclosers sense and briefly interrupt fault currents, and then automatically reclose to restore service. Meanwhile, downstream sectionalizers automatically count current interruptions by the recloser. When a sectionalizer detects a preset number of interruptions of fault current (typically 3 or 4) the sectionalizer opens (while unenergized) and remains open, and the recloser restores supply to the other non-fault sections.

A fuse cutout consists of three major components. The first component is the cutout insulator body, a generally open "C"-shaped frame that supports a fuse holder and a ribbed porcelain or polymer insulator that electrically isolates the conductive portions of the assembly from the support to which the insulator is fastened. The second component is the fuse element, or "fuse link", which is the replaceable portion of the cutout assembly that operates when the electrical current is great enough. The third component is the fuse holder, also called the "fuse tube", which is an insulating tube which contains the replaceable fuse element. When the fuse element operates ("blows"), the fuse holder breaks the circuit, then drops out of the upper contact, and hangs from a hinge on its lower end. The hanging fuse holder provides a visible indication that the fuse has operated and assurance that the circuit is open.

An overcurrent caused by a fault in the transformer or customer circuit will cause the fuse to melt, disconnecting the transformer or faulted circuit from the line. To facilitate disconnection, cutouts are typically mounted about 20 degrees off vertical so that the center of gravity of the fuse holder is displaced and the fuse holder will rotate and fall open under its own weight when the fuse blows. Mechanical tension on the fuse link normally holds an ejector spring in a biased position. When the fuse blows, the released spring pulls the stub of the fuse link out of the fuse holder tube during the fault clearing process. The electric arc is quenched within the fuse holder, limiting duration of the fault event. The cutout can also be opened manually by utility linemen standing on the ground and using a long insulating stick called a "hot stick".

In operation, after the fuse link has blown and the fuse holder drops, a lineman replaces the fuse link and re-deploys the fuse tube in its operating condition. The fuse holder is also equipped with a pull ring that can be engaged by a hook at the end of a fiberglass hot stick operated by a lineworker standing on the ground or from a bucket truck, to manually open the switch.

As will be appreciated by one of ordinary skill in the art, up until the mid-1970s, each manufacturer used their own dimensional standards for cutout designs. The plethora of designs resulted in the inability to use replacement fuse holders from one manufacturer to service or repair the cutouts of another manufacturer. By the late 1980s, the industry moved to a standard design that resulted in the interchangeability of fuse holders between the manufacturers. In other words, the interchangeable design allows for the interchangeable use of cutout bodies, fuse holders, and fuses manufactured by different vendors.

One drawback with the adoption of interchangeable designs is the stagnation of the state of the art. In an effort to maintain the interchangeability of the parts, little has been done to improve upon existing designs. Such stagnation has led to the inevitable problems of acquiescence in the configuration and expense of the parts and materials, and in particular that of the fuse holder; as well as acquiescence in component failure rates such as those known in the art occurring from heating, melting, and welding that are currently deemed unavoidable and a fact of life when it comes to fuse tubes.

The foregoing underscores some of the problems associated with conventional fuse holders. Furthermore, the foregoing highlights the long-felt, yet unresolved need in the art for a fuse holder that lessons the phenomena of heating, melting, and welding that are associated with prior art fuse holder. Moreover, the foregoing highlights the long-felt, yet unresolved need in the art for a fuse holder that has an extended service life at a reasonable cost.

SUMMARY OF THE INVENTION

Various embodiments of the present invention overcome various of the aforementioned and other disadvantages associated with prior art fuse holders and offers new advantages as well. The present invention is based, in part, on the discovery that unexpectedly superior electrical properties may be realized by modifying the shape and configuration of fuse tubes. The present inventors went against the great weight of the teachings in the art and the incredulity of prior artisans to construct fuse tubes having various permutations of the features of a shorter length tube, reduced wall thickness of the windings, 2-layer synthetic tubes (utilizing epoxy resin for the matrix with polyester fiber and e-glass fiber as the composite reinforcement reinforcement materials), a synthetic arc quenching liner, a unitary hook stick casting including the arc tube flange, and composite encasement compression molding. Although not wishing to be bound by theory, the present inventors' various permutations of advantageous features lead to unexpected results in a higher conductivity circuit that leads to less welding as well as the ability to use less expensive materials without increasing the likelihood of welding. Furthermore, various permutations of the advantageous features of the invention reduce arc length and resistance, thereby achieving lower arc energy with less upward force during the interrupting process. Additionally, the various embodiments of the advantageous features of the present invention result in lower cost products, eliminate the need for the bronze lower casting, and result in a lower weight final product, thereby making fuse holder installation and removal more compatible with commonly used telescopic extendo sticks.

According to one aspect of various embodiments, there is provided a fuse holder comprising a shorter fuse tube. The shorter fuse tube reduces the arc length resistance thereby achieving lower arc energy with less upward force during the interrupting process and, perhaps more importantly, the radial burst pressure is also substantially reduced roughly proportional to the arc length reduction.

According to a related aspect of various embodiments, a shorter fuse tube is made possible by the provision of a "fin" or flange member extending from the fuse tube body and extending to an area for connection to a trunnion of a fuse cutout. In accordance with this aspect of the invention, the flange is a molded member integral with the tube body and extending in a manner that obviates the need for a long tube and a bottom casting for connection to a trunion.

According to another aspect of various embodiments, an arc sleeve and top casting member are provided that are configured such that the flange of the arc sleeve sits atop the top edge of the top casting. In accordance with a preferred embodiment of the invention, the top casting is a one-piece integral top casting including a pull ring. One potential advantageous feature of the one-piece casting including a pull ring is the ability to move the arc flange up to the hook stick casting, to lessen the occurrences of heating and melting issues. Moving the arc sleeve may result in a higher conductivity circuit between the top threaded cap, fuse link, and arc sleeve. Thus reducing the problem of welding these separable components together.

The hook stick casting could also be a stamping, wherein the degree of conductivity is no longer critical when the arc sleeve is terminated above it such that the fuse button is in direct contact with the arc sleeve. The hook stick loop has to be included in the conductive path so that a hot stick using an "arc tamer" can interrupt the circuit when a lineman opens the fuse holder (also known as a fuse door). But, high conductivity is no longer important and the casting or stamping can be produced using lower conductivity materials.

In a related aspect of a preferred embodiment of the invention, the fuse tube body includes a slit or notch adapted to allow a one-piece top casting including a pull ring to be seated at least partially within the central bore of the fuse tube. In a further related aspect, the arc sleeve includes a flange that rests on the upper outer edge of the top casting, thereby ensuring the arc sleeve is above the top casting. In an alternative embodiment, the top casting is positioned butt up against the tube.

According to another aspect of various embodiments of the present invention there is provided a fuse holder comprising an arc-quenching liner. The liner may comprise bone fiber as commonly deployed in the art. Alternatively, the liner may be a synthetic liner comprising a cross-linked fiberglass shell overmolded with plastic weathershed, or filament wind/grind/epoxy paint coating or, preferably, filament wind/over mold where the overmolded material is thermal set BMC or thermal plastic having weathering resistive compositional addititives. Further, the overmolded material could continue to be also paint.

In a preferred embodiment, the liner utilizes epoxy resin for the matrix, with polyester fiber and e-glass fiber as the composite reinforcement materials. Preferably, ATH is added to the resin as the main constituent to generate arc quenching gasses. The polyester fiber ablates to expose more ATH through successive operations.

In accordance with these and other advantageous aspects of the invention, presently preferred embodiments of a fuse holder comprise a fuse tube, an injection, compression, or transfer molded component, an arc quenching liner, an arc sleeve and a top casting.

Another advantageous feature of preferred embodiments is the ability to eliminate the conventional bronze lower tube casting, aiding in the overall weight reduction of the fuse holder, making the fuse holder installation and removal more compatible with common telescopic extend sticks.

Another advantageous feature of preferred embodiments of the invention is the ability to use less expensive, albeit more susceptible to welding, materials because the reduction in heating and melting energy offsets the increased susceptibility to welding of the materials used today.

According to the invention, a presently preferred embodiment of a fuse tube assembly comprises a core containing ablative arc extinguishing ingredients; a composite reinforcing structure; an integral lower hinge point molded within the composite reinforcing structure; a conductive hook stick loop; high conductivity arc tube; and a removable high conductivity contact (threaded cap) all bonded to the fuse current path.

The drawings are for illustration purposes only and are not drawn to scale unless otherwise indicated. The drawings are not intended to limit the scope of the invention.

BRIEF DESCRIPTION OF THE DRAWINGS

Various aspects and advantageous features of the present invention will become more apparent to those of ordinary skill when described in the detailed description of a preferred embodiment and reference to the accompany drawing wherein.

DETAILED DESCRIPTION OF THE PREFERRED EMBODIMENT

While the present invention will be described in connection with a fuse holder for a fuse cutout for a power distribution system, it will be readily apparent to one skilled in the art armed with the present specification that the present invention can be applied to a multiplicity of fields and uses. In particular, the present invention may find use in other areas where reduction in welding is desirable. Likewise, the present invention may be advantageous in other cut out applied products including but not limited to current limiting fuses, power fuses, sectionalizer and switch blade assemblies, and the like. The present system may be easily modified to include different configurations, mechanisms, methods, and kits, which achieve some or all of the purposes of the present invention.

Figure 1A:
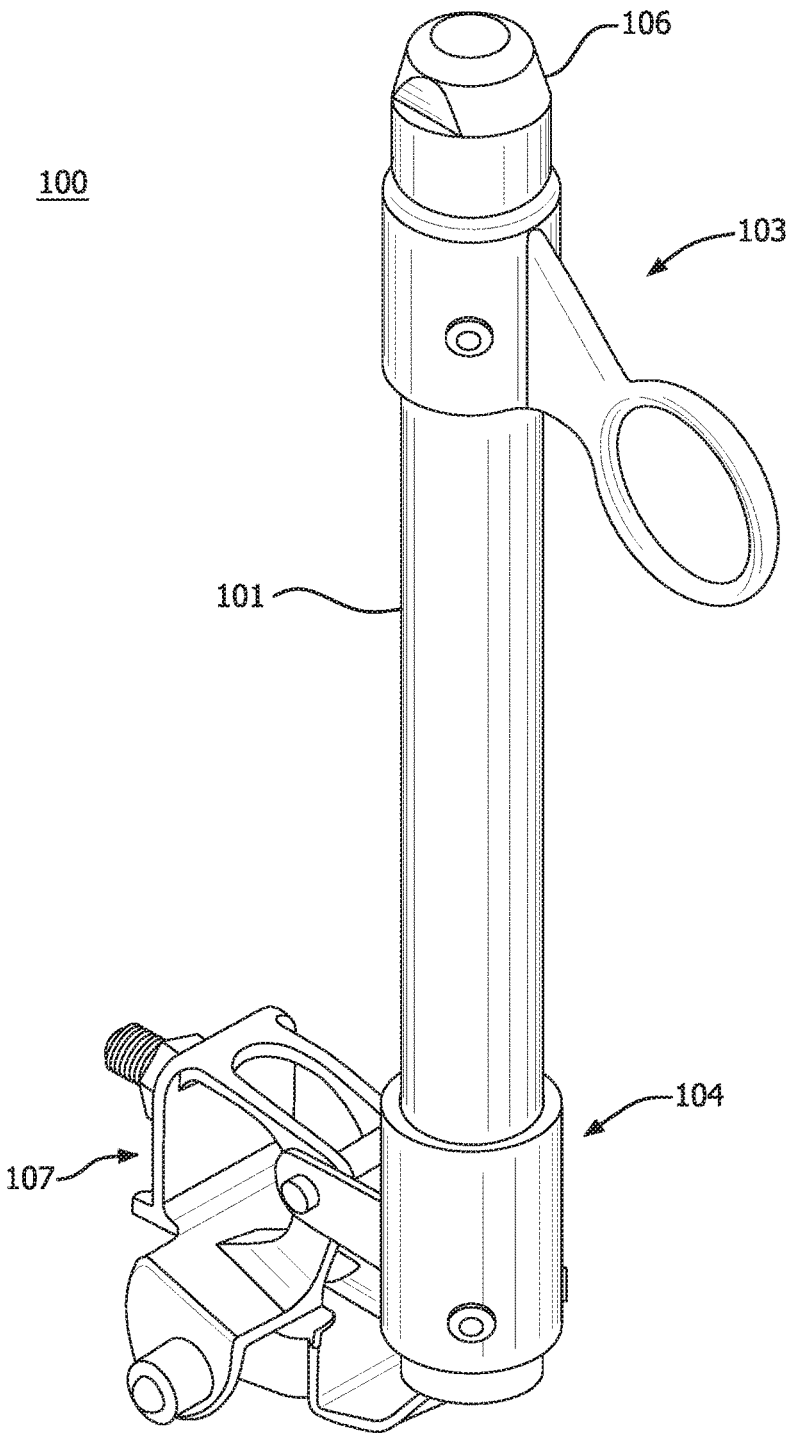
FIG. 1A (PRIOR ART)
FIG. 1A is a perspective view of a prior art fuse holder assembly of the type commonly used in the power system industry today.
Figure 1B:
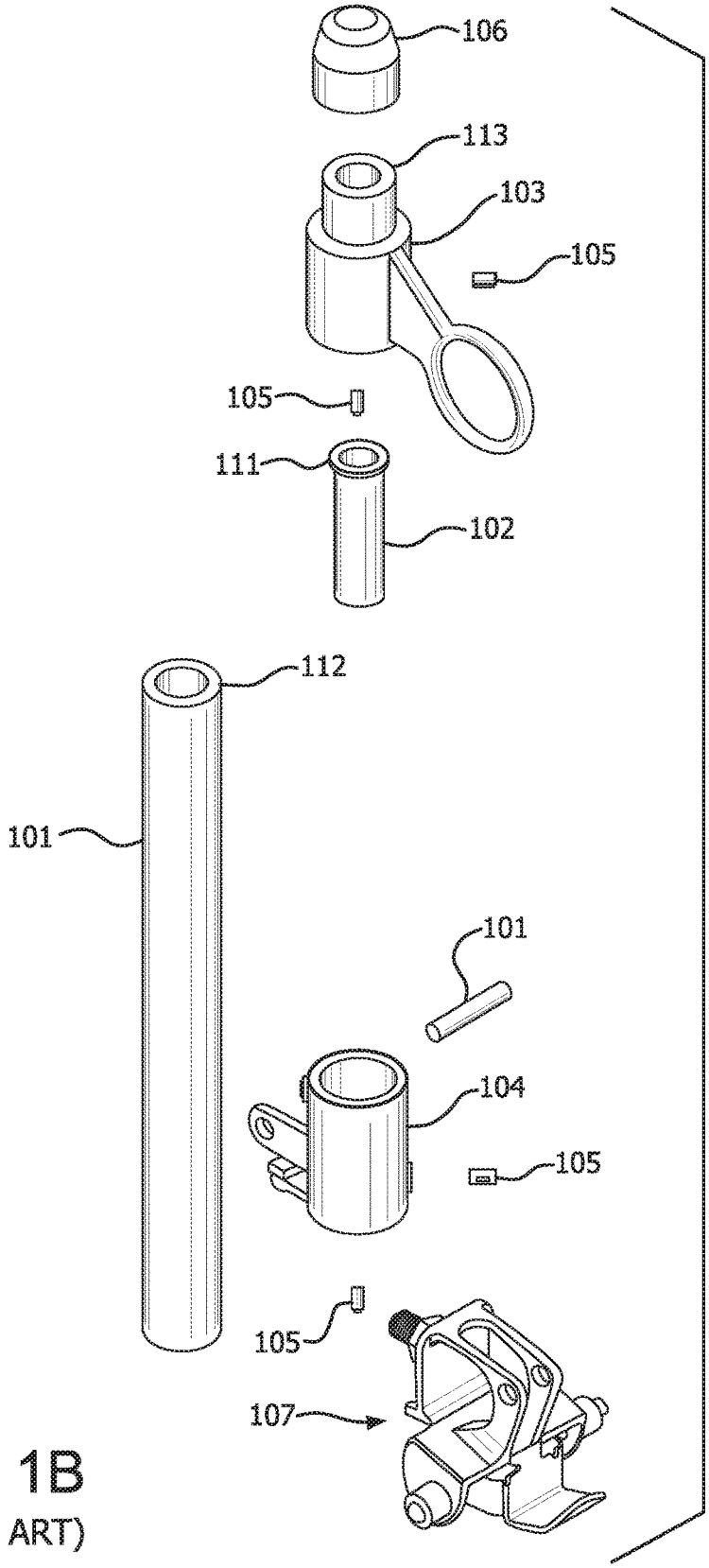
FIG. 1B (PRIOR ART)
FIG. 1B is an exploded perspective view of a prior art fuse holder assembly of the type commonly used in the power system industry today.

Turning to the Figures, a prior art fuse tube commonly used in fuse cutouts today is depicted in FIGS. 1A and 1B. As depicted, prior art fuse tubes 100 include a tube body 101, an arc sleeve 102, a top or "hook stick" casting 103 and a bottom or "hinged tube" casting 104. The top and bottom castings 103, 104 are connected to the tube body 101 by pairs of rivets 105. A screw cap 106 seals the top of the tube assembly. A trunnion assembly 107 is connected to the bottom casting 104 via a trunnion protrusion being received in an axial opening 108 extending through a laterally extending arm 109 and secured in place with a trunnion pin 110. The fuse tube 100 once assembled is ready for deployment as part of a fuse cutout or the like.

With particular reference to FIG. 1B, it is important to note that prior art fuse tubes 100 are configured such that the arc sleeve 102 is inserted into the bore of the tube body 101 and seated in place by a flange 111 of the arc sleeve 102 resting on the end of the circumferential side wall 112 of the tube body 101. The top casting 103 has a diameter wider than that of the fuse tube such that the top casting 103 is placed over the flange 111 and tube end 112 such that a suitably sized bore in the wider top casting 103 receives the arc sleeve flange partway therein and resting on an narrower neck section. A narrower threaded portion 113 then extends from the neck area above the bore area and receives the screw cap 106 internal threads. As such, the arc sleeve and flange 111 are always seated below the top of the top casting 103.

By contrast, as discussed in more detail below, presently preferred embodiments of a fuse tube in accordance with the present invention differ in several material respects. To elaborate in more detail, a presently preferred embodiment of a fuse tube 10 incorporating various advantageous features of various embodiments of the invention is depicted in FIGS. 2-17

As shown, the fuse tube 10 comprises a tube body 11, an arc sleeve 12, a hook stick member 13, a molded member 14 (used to the exclusion of the bottom casting of prior art fuse tubes), and a synthetic liner 15. As discernible from a comparison of FIGS. 1A-B and FIGS. 2-3, the depicted embodiment of the present invention provides a shorter tube body 11, a modified hook stick member 13, a "fin" or flange 14 extending from the sidewall of the tube body 11 defining a hinge area (in lieu of a bottom casting). Furthermore, the arc sleeve 12 is positioned such that the arc flange 16 sits above the top casting before being sealed in place via screw cap 17. The trunion assembly 18 is deployed by utilizing a hole 19 extending through the fin 14 and a hinge pin. The significance of these physical differences between embodiments of the present invention and the prior art will be explained in more detail herein.

In addition, while not discernible, other modifications include the use of a 2-layer synthetic tube comprising a first layer of polyester/resin and a second layer of fiberglass (and resulting in a reduced wall thickness), as well as having the molded member fabricated by encasement molding.

To elaborate, first with respect to the synthetic material, prior art fuse tubes use a 2-layer synthetic material for the body of the tube. These prior art tubes are also surface ground and coated with an epoxy paint for weathering resistance. The ground surface is required to provide a press fit for the castings. Similarly, preferred embodiments of fuse tubes in accordance with the invention use 2-layer synthetic material. In both cases, the inner layers are wrapped with polyester fiber, while the outer layers are wrapped e-glass fiber. However, presently preferred fuse tubes in accordance with a presently preferred embodiment of the invention reduce e-glass layers for two reasons: (1) The e-glass layers provide burst strength, e-glass contained within the bulk molding compound (BMC) also contribute to burst strength; and (2) The tube is not ground to a reduced and uniform outside diameter as is the prior art tube. The elimination of grinding is both a cost savings and an enhancement. As will be appreciated, after grinding, e-glass fibers are exposed and must be sealed in the epoxy paint to prevent weathering damage. Furthermore, molding the tube in BMC enables incorporating the lower hinge point previously facilitated by the lower casting. By molding this shape in place, the present inventors we were also able to reduce the length of the fuse tube bore and optimize interruption characteristics resulting in lower arc energy. The surprising and unexpectedly superior arc quenching resulting from the various embodiments of the present invention is a particularly noteworthy advantage over prior art fuse tube configurations.

Returning to the prior art tube of FIGS. 1A and 1B, the fuse tube configuration illustrates some of the problems in the art. For starters, the fiberglass tube 101 is longer, resulting in higher arc energy. A long tube was required to facilitate mounting of a bronze hinge assembly which is more expensive and results in higher arc energies as well as increased erosion of the tube liner. The provision of an arc sleeve 102 reduces the arc length during operation. Again, as alluded to above and as shown in FIG. 1B, prior art fuse tubes 100 and arc sleeves 102 are universally positioned internally such that the arc tube flange 111 is located Inside and below the top surface of the hook stick member 103.

Figure 3:
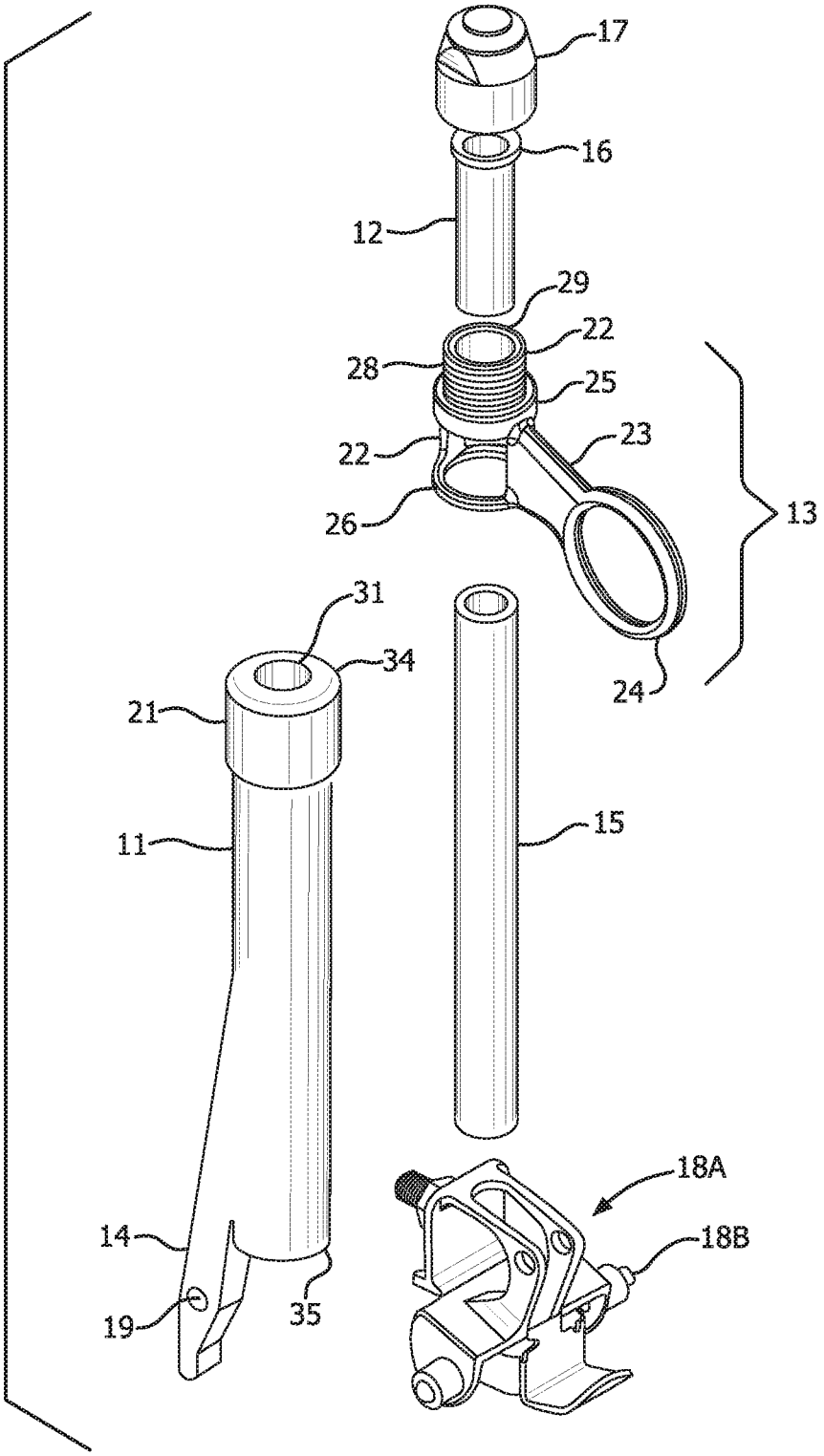
FIG. 3 is an exploded perspective view of the fuse holder assembly of FIG. 2.

By contrast, according to a preferred embodiment of the present invention, and as shown in FIG. 3, the arc flange 16 is moved above the hook stick member 13 and the fuse is captured between the flange 16 and the top screw cap 17 which provides an enormous, unexpected benefit. Specifically, when the flange is present below the hook stick (as universally true in existing fuse tubes), then the flange is in the circuit 100% of the time once the screw cap member is secured. Accordingly, concomitant heating and melting issues are ever present by virtue of being in the circuit. To be more specific, the issue with the placement of prior art arc tubes is that the bronze used in hookstick castings is lower in conductivity than the copper in the arc tube, the fuse, and the cap. Thus, as will be appreciated, the casting may lead to welding issues.

When the arc sleeve 12 and flange 16 are moved up, the higher conductivity results which equates to less heating and welding. By reducing the problem of welding associated with prior art fuse tubes, the present invention fosters the ability to make the hook stick member of less expensive material, e.g., the reduction in overheating means less expensive materials that are available but traditionally more prone to welding can be used without increasing the likelihood of welding in the new design. Additionally, due to shorter arc length, embodiments of the invention may realize the potential for use of a lower conductivity arc sleeve.

Returning to the Figures, the fuse holder of the depicted embodiment of the present invention still lends itself to interchangeable use with exiting fuse cutouts and fuse holder assemblies given that the length of the fuse tube body and fin member corresponds to the length of prior art tubes including bottom castings. This standard length allows fuse holders of the present invention to be deployed in fuse cutouts and the like currently in use in the field.

Figure 2:
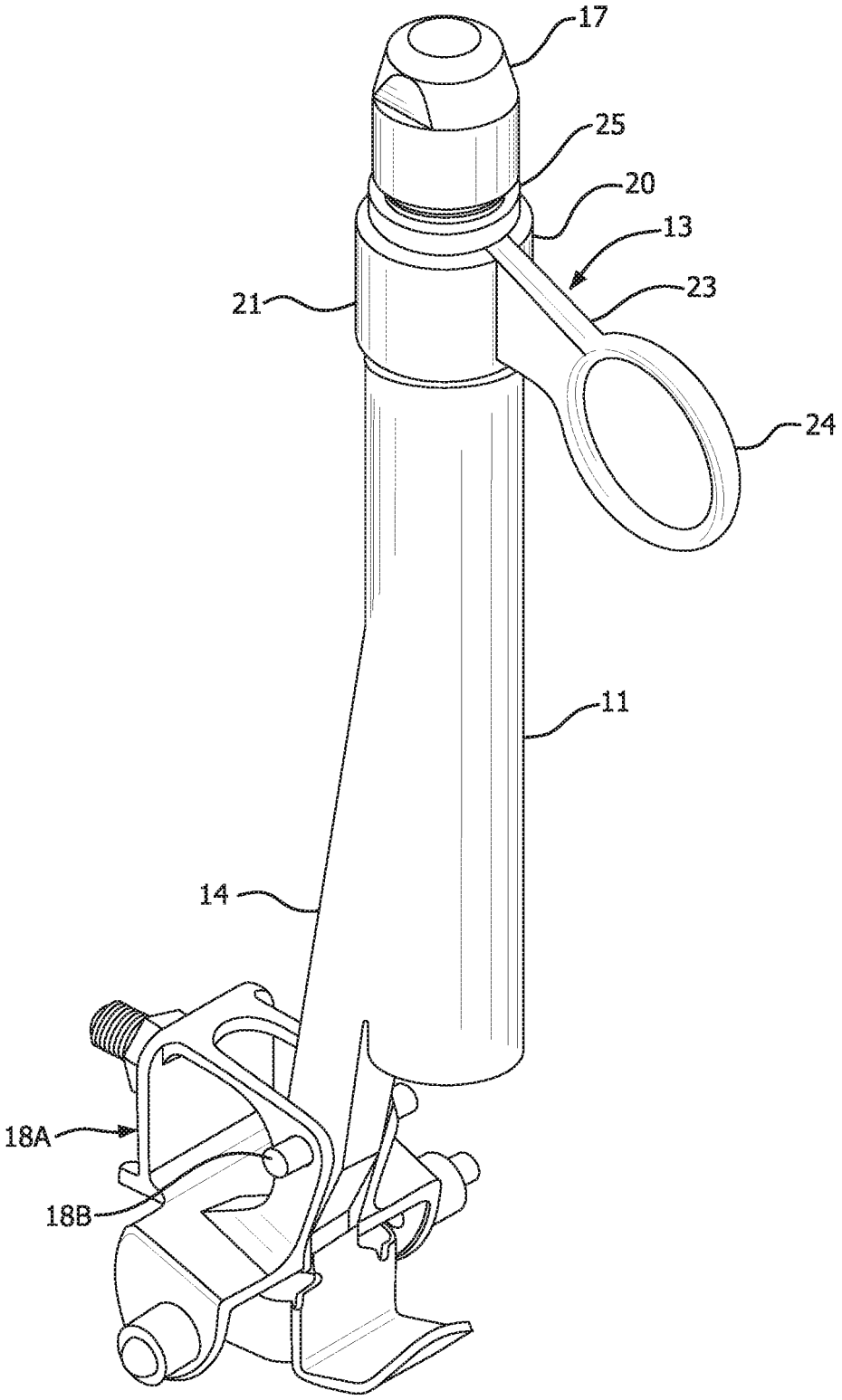
FIG. 2 is a perspective view of a fuse holder assembly according to an exemplary embodiment.
Figure 4:
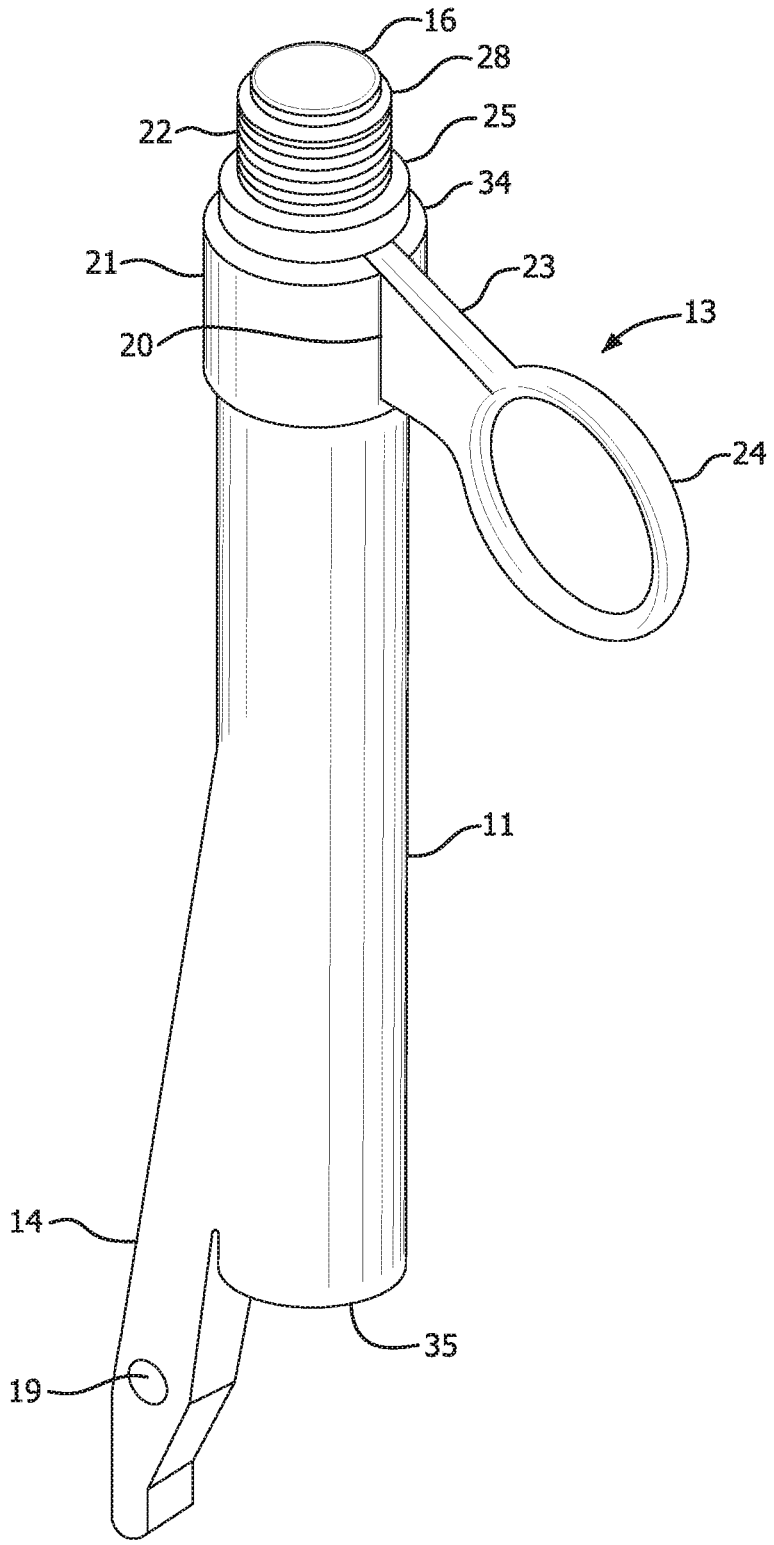
FIG. 4 is a perspective view of the assembled tube body and top casting of FIG. 2.

Also, similar to existing prior art fuse holders, the fuse holders 10 of the present invention may include a top casting 13 connected to an upper end of a fuse tube body 11. In a presently preferred embodiment, an injection molded fuse tube body 11 secures the top casting 13 to the fuse tube. As best shown in FIGS. 2 and 4, the fuse tube 11 includes a notch or slit 20 sized to receive an arm 23 of the hook stick casting 13 which allows the casting 13 to be slid down a length of the tube body 11. In contrast to prior art fuse tubes wherein the top casting is wider and received over the outside end of the tube body, the embodiment of the figures shows that the molded body 11 has a bulbous or wide section 21 (mimicking the size and shape of a prior art top casting) that includes the notch 20 for receiving the top casting 13 in the interior of the tube body 11.

Figure 5:
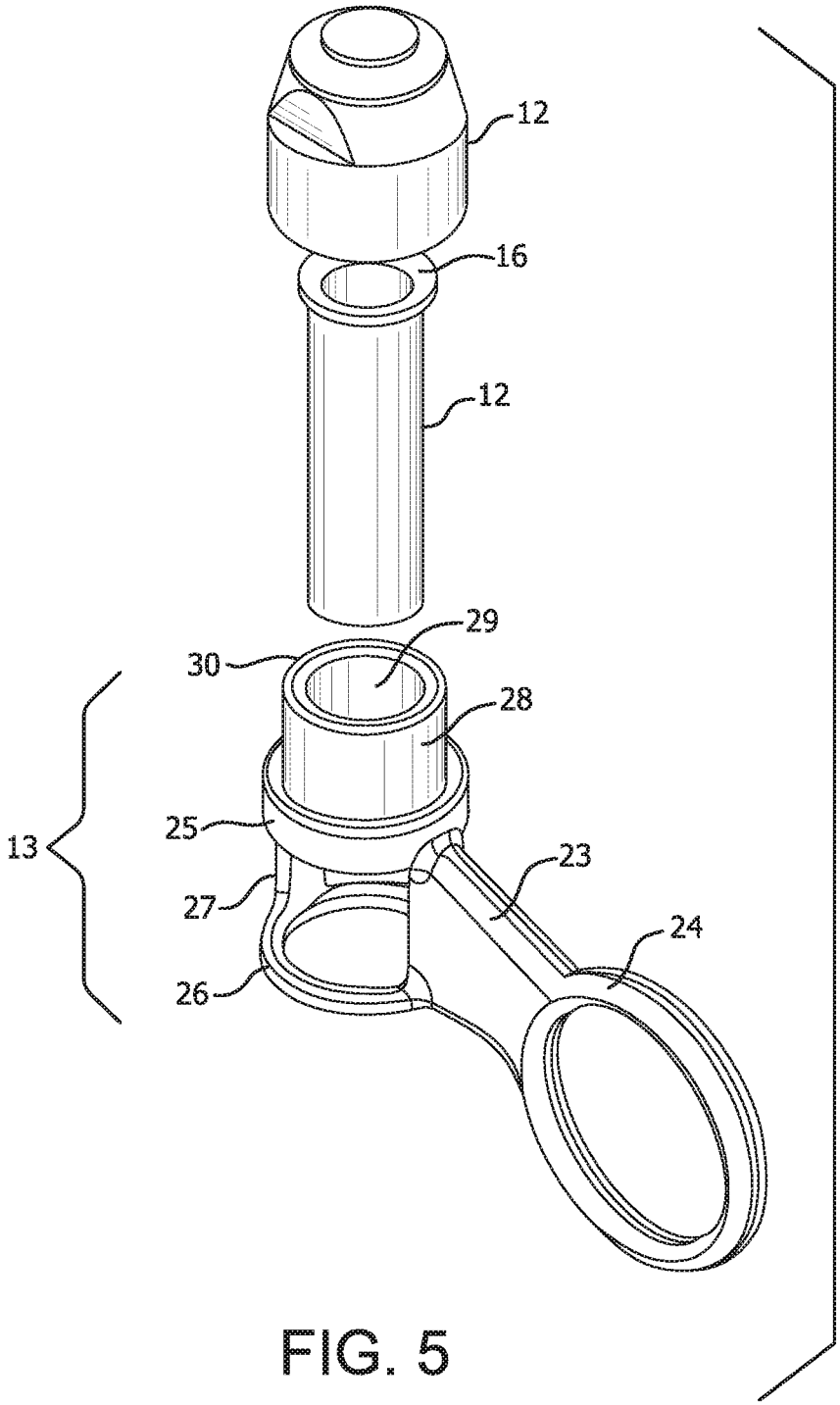
FIG. 5 is depicts an enlarged exploded perspective view of the top casting, arc sleeve, and cap of FIG. 2.
Figure 6:
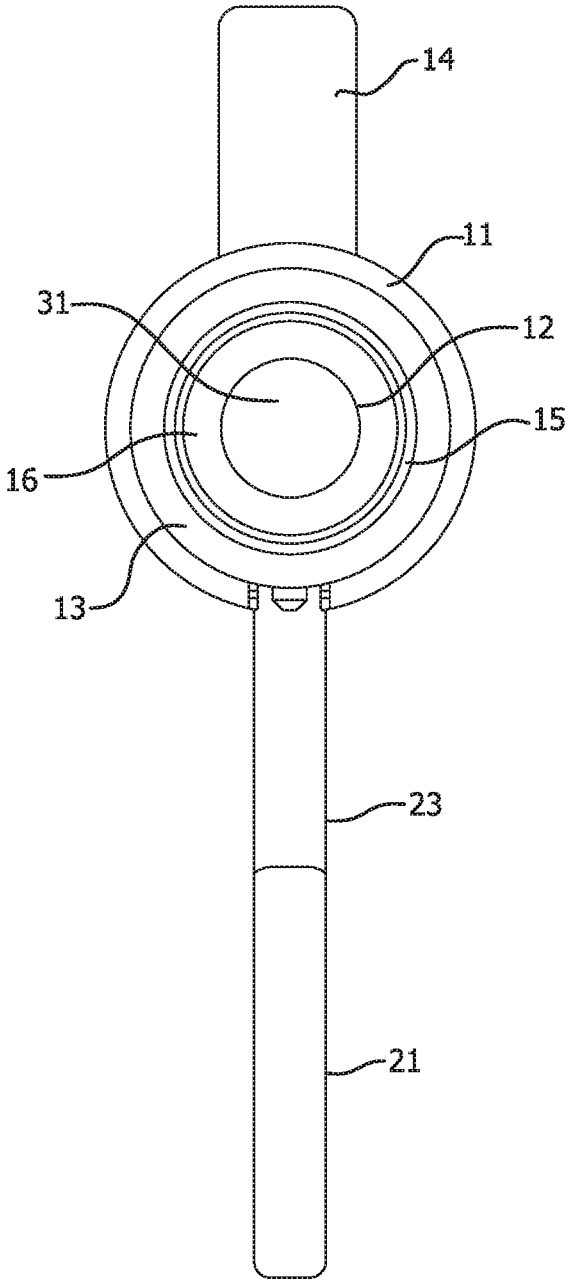
FIG. 6 is a top plan view of the top casting area of the assembled fuse tube assembly of FIG. 2.

As best shown in FIG. 5, a presently preferred embodiment of the top casting 13 includes an upper ring 25 axially spaced from a lower ring 26. A plurality of axially extending ribs 27 connect the upper and lower rings 25 and 26. The pull-ring 24 extends outwardly from one of the ribs 27. A neck portion 28 extends axially and upwardly from the upper ring 25. A bore 29 through the body 28 receives the arc sleeve 12, as shown in FIG. 5. The flange 16 of the arc sleeve 12 engages a top edge 30 of the neck 28. The neck 28 preferably includes 22 threads for receiving a screw cap 17.

As configured in the present embodiment, the axial spacing between the upper and lower rings 25 and 26 allows the material used to form the injection molded fuse tube body 11 to access the arc sleeve 12 disposed therein, thereby bonding the arc sleeve 12 to the fuse tube 10. In addition, to facilitate deployment and use similar to prior art fuse tubes, the molded fuse tube body 11 includes a fin portion 14 having an opening 19A to receive a trunnion 18 (securable by a trunnion pin 19B), while the top casting 13 includes an integral pull ring 24 for receiving a hookstick and a threaded neck 28 for receiving a screw cap 17.

The injection molded fuse tube body 11 including a fin portion 14 eliminates the need for a lower casting disposed at an opposite end of the fuse tube body 11 from the top casting 13. Eliminating a lower tube casting can facilitate reduction of the overall length of the fuse tube body 11, thereby reducing arc length and resistance. Preferably, a thermal set composite is used for the injection molded component, although any suitable material can be used, such as a thermal plastic composite. Additionally, the weight of the fuse holder assembly 10 is reduced, thereby facilitating installation and removal of the fuseholder assembly 10.

A synthetic liner 15 or bone fiber and even boric acid, which is typically found in a power fuse is disposed in a bore 31 of the fuse tube 11. The synthetic liner 15 is disposed within the fuse bore 31 and either abuts or overlaps the arc sleeve 12.

An arc sleeve 12 is connected at an upper end of the fuse tube 11. A flange 16 of the arc sleeve 12 is disposed above the top casting 13. This configuration facilitates direct contact to the fuse link and upper contact that will reduce localized arcing under fault conditions. This reduction prevents those parts from welding together making it easier for linemen to remove spent button heads during refusing operations. Such configuration is obtainable because the injection molded component bonds the arc sleeve 12 in position such that the flange 16 is disposed above the top casting 13.

Figure 7:
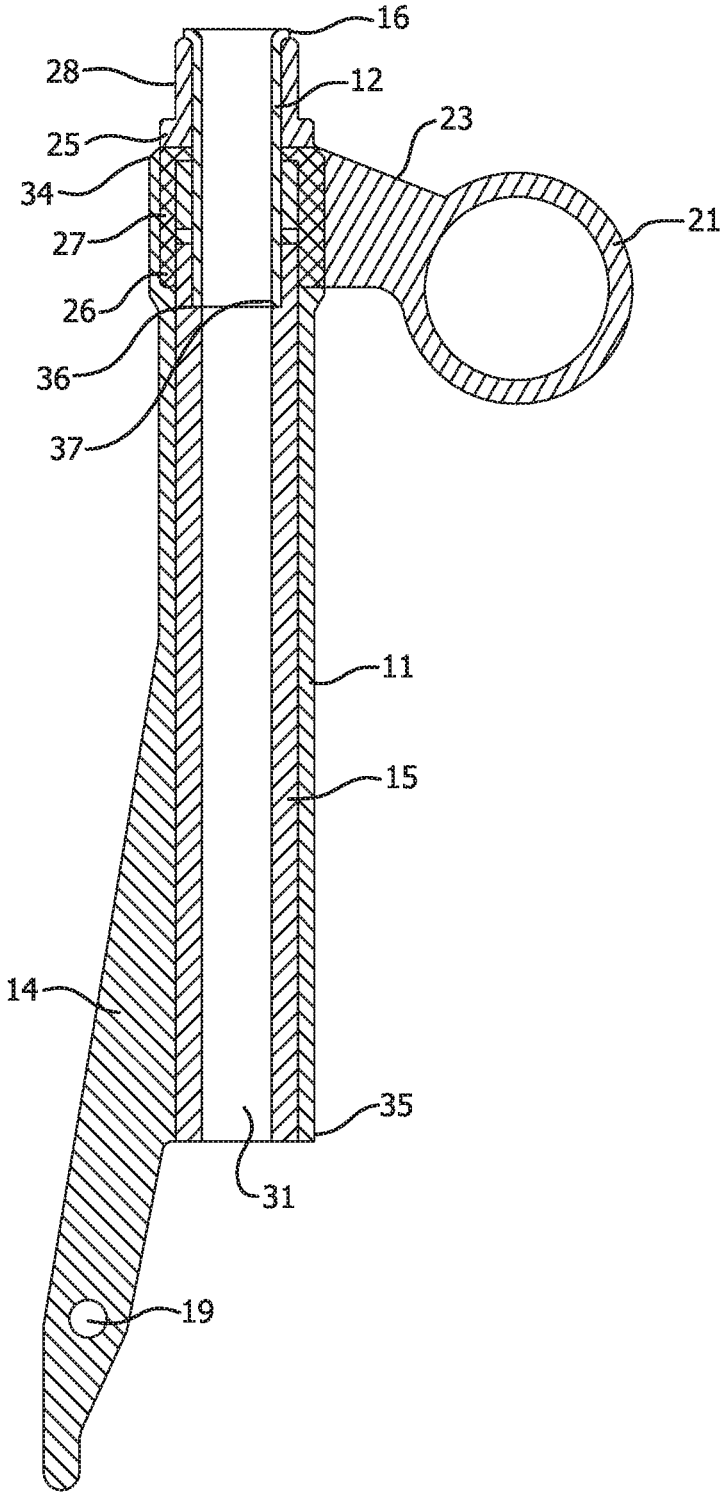
FIG. 7 is a side elevational view in section of the fuse tube assembly complete without cap of FIG. 2.

As best shown in FIG. 7, the fuse tube 11 has a bore 31 extending from a first end 34 to a second end 35. The interior is lined with the synthetic liner 15 up to an area coinciding with the bulbous portion 21 of the tube 11. An internal shoulder 36 defined by the bottom interior of the bulbous section 21 and/or the synthetic liner 15 receives an end 37 of the arc sleeve 12.

In a presently preferred embodiment, a fuse tube according to the present invention may be configured for use with embodiments of the fuse cutout insulator described in co-pending U.S. application Ser. No. TBD filed this same day by the present inventors and entitled "FUSE CUTOUT INSULATOR," the entire contents of which are hereby incorporated by reference in their entirety.

Various adaptations and modifications of the above-described preferred embodiments can be configured without departing from the scope and spirit of the invention. Therefore, it is to be understood that, within the scope of the appended claims, the invention may be practiced other than as specifically described.

We claim:

1. A fuse holder comprising:

a tube body having a sidewall defining a central bore extending from a top end to a bottom end of said tube body;

a top casting having a generally ring-shaped configuration defining a central opening and positioned in an area adjacent said top end of said tube body; and, an arc sleeve positioned within said central opening of said top casting such that a top end of said arc sleeve resting at or above a top edge of said top casting, at least a bottom end of said arc sleeve extending into the central opening of said top casting and into the central bore of said tube body.

2. The fuse holder of claim 1, wherein an arc liner is disposed in said central bore of said tube body.

3. The fuse holder of claim 2, wherein said arc liner comprises bone fiber or a cross-linked fiberglass shell overmolded with plastic weathershed.

4. The fuse holder of claim 3, wherein said top casting includes a lateral extending arm and a pull ring.

5. The fuse holder of claim 4, wherein said top casting comprises a unitary casting.

6. The fuse holder of claim 1, wherein said tube body comprises an injection, compression, or transfer molded body.

7. The fuse holder of claim 6, wherein said tube body includes a fin member extending below a shortened bottom end of said tube body.

8. The fuse holder of claim 6, wherein said tube body includes a bulbous top portion having a slit.

9. The fuse holder of claim 1, further comprising a screw cap that screws onto threads disposed on a top neck portion of said top casting.

10. The fuse holder of claim 1, wherein said arc sleeve comprises an arc flange and a sleeve body; and wherein said arc sleeve is positioned within the central opening of said top casting such that said arc flange rests on a lip of a top end of said top casting and said arc sleeve extends into the central opening of said top member and into the central bore of said tube body.

11. A fuse holder assembly comprising:

a fuse tube having a molded tube body having a top end, a bottom end, and an integrally formed fin member extending longitudinally from said tube body to an area below said bottom end;

a top casting attached to said top end of said tube body; and, an arc sleeve positioned in an internal area of said top casting and extending into a central passage in said tube body.

12. The fuse holder of claim 11, wherein said arc sleeve includes a flange that is positioned above said top casting.

13. The fuse holder assembly of claim 12, wherein an arc quenching liner is disposed in the central passage of said tube body.

14. The fuse holder assembly of claim 13, wherein said arc quenching liner comprises bone fiber, boric acid, or a synthetic material.

15. The fuse holder assembly of claim 13, wherein said assembly uses a two-layer synthetic tube body comprising an epoxy resin with polyester fiber and e-glass fiber reinforcement materials.

16. The fuse holder assembly of claim 15, wherein said resin includes ATH.

17. The fuse holder assembly of claim 11, wherein said top casting is a unitary casting and comprises an upper ring axially spaced from and connected to a lower ring by a plurality of axially extending ribs, a pull-ring at an end of an arm extending outwardly from one of said ribs, and a threaded neck portion extending axially from said upper ring; said neck portion including a terminating end lip for receiving a flange of said arc sleeve, thereby holding said arc flange above said top casting.

18. The fuse holder assembly of claim 17, further comprising a conductive screw cap screwed onto said threaded neck portion.

19. The fuse holder of claim 18, wherein said tube body includes an upper bulbous section on said top end, said bulbous section including a slit that accepts said arm of said top casting and wherein said central passage accepts at least a portion of said lower ring of said top casting, and a hole through a bottom area of said fin member, said hole accepting a hinge pin to connect a trunion member to said fuse holder for deployment in a fuse cutout assembly.

20. A fuse tube for a fuse cutout, comprising:

a molded body including a tube section and an integrally molded fin section, said molded body sized to fit in said fuse cutout, said fin section including a downwardly extending arm having a hinge pin hole hingedly attaching a trunion assembly, said tube section including an arc quenching liner deployed internally therein;

a top casting including a pull ring; said top casting having an annular main body portion connected to a top end of said molded body;

an arc sleeve, said arc sleeve including an arc flange engaging a top edge of said top casting, thereby keeping said arc flange above said top casting;

a top conductive cap threaded onto said top casting for placement in said fuse cutout.

* * * * *